US006935503B2

(12) United States Patent
Phan

(10) Patent No.: US 6,935,503 B2
(45) Date of Patent: Aug. 30, 2005

(54) SELF-TELESCOPING STORAGE ENCLOSURE

(75) Inventor: Christopher L. Phan, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 31 days.

(21) Appl. No.: 10/676,604

(22) Filed: Oct. 1, 2003

(65) Prior Publication Data

US 2004/0118736 A1 Jun. 24, 2004

Related U.S. Application Data

(60) Provisional application No. 60/416,287, filed on Oct. 4, 2002.

(51) Int. Cl.[7] ..... B65D 21/00; B65D 5/00; B65D 43/04

(52) U.S. Cl. ..... 206/507; 229/108; 229/125.32; 229/164; 229/901

(58) Field of Search ..... 206/505, 507; 229/112–114, 125.19, 125.29, 164, 901, 125.32

(56) References Cited

U.S. PATENT DOCUMENTS 1,932,429 A * 10/1933 Wellman ..... 229/125.19
2,316,457 A 4/1943 Royce
3,027,062 A * 3/1962 Huss et al. ..... 229/125.28
4,244,509 A * 1/1981 Dlugopolski ..... 229/164
5,060,851 A * 10/1991 Lorenz ..... 229/125.29
5,160,081 A 11/1992 Beales
5,590,788 A 1/1997 Inman

FOREIGN PATENT DOCUMENTS

DE 200 14 366 U 1 1/2001
EP 1 069 047 A1 1/2001
WO WO 93/11048 * 6/1993 ..... 229/125.19

OTHER PUBLICATIONS

International Search Report dated Apr. 19, 2004 of International Application No. PCT/US 03/31301.
Notification of Transmittal of the International Preliminary Examination Report in International Application No. PCT/US 03/31301 dated Jan. 11, 2005.

* cited by examiner

*Primary Examiner*—Bryon P. Gehman
(74) *Attorney, Agent, or Firm*—Marshall, Gerstein & Borun LLP

(57) ABSTRACT

A self-telescoping storage enclosure comprises a first tray that includes a bottom wall, and a major wall, a minor wall, a right wall, a left wall extending up from the bottom wall. The major wall and the minor wall each having an outer surface. The left wall and the right wall each have a notch. The outer surface of the major wall defines a first major outer width, and the outer surface of the minor wall defines a first minor outer width, the first major outer width being greater than the first minor outer width. The first tray can nest with a second tray substantially similar to the first tray that is inverted and oriented 180° relative to the first tray by the inter-engagement of their respective notches.

19 Claims, 4 Drawing Sheets

SELF-TELESCOPING STORAGE ENCLOSURE

CROSS-REFERENCE

This application claims priority to U.S. Provisional Application Ser. No. 60/416,287, filed Oct. 4, 2002.

FIELD OF THE INVENTION

The invention relates to a storage enclosure, and more particularly to an enclosure with telescoping top and bottom trays.

BACKGROUND OF THE INVENTION

Telescoping trays are convenient devices that can be used to form a storage enclosure and to store items. Items can be placed into a tray by a consumer who wishes to store and organize the items. Items can also be placed in a tray by a manufacturer, after which the tray is closed to form an enclosure, such that a retailer need only open the tray to display and present the items stored in the tray for sale.

In a conventional design, a telescoping tray storage enclosure is formed of two pieces, a top tray and a bottom tray. Each of the top and bottom trays are parallelepipeds, each having one open face. The open face of the top tray is placed over the open face of the bottom tray, and the two trays are matingly moved together such that a box is formed. In such a conventional design, as shown in exaggerated format in FIG. 1, the length and width of the top tray are slightly longer and wider than the length and width of the bottom tray such that, when the trays are placed together, the top tray entirely overlies and encompasses the bottom tray, and the edges of the top tray surround and cover the edges of the bottom tray.

In the conventional design, two parts of different sizes are required. Thus, it requires two different tools to manufacture the two parts, two different sets of inventory, etc. If one part becomes damaged, the specific part must be replaced, which could lead to confusion.

Figure 1:
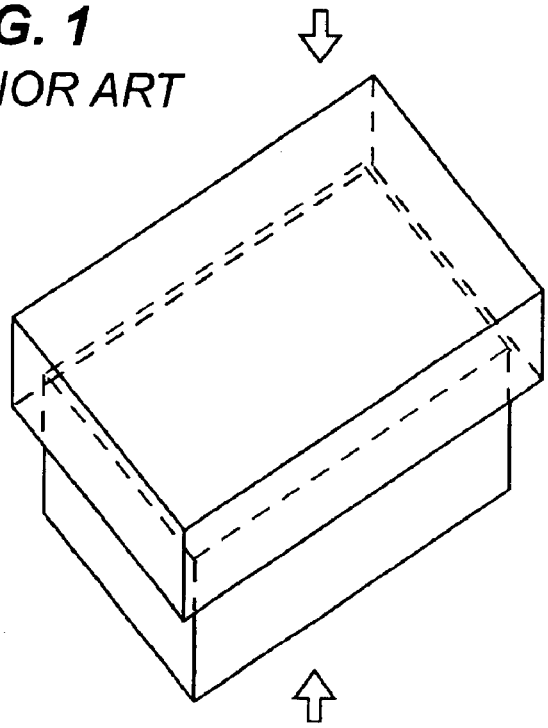
FIG. 1 PRIOR ART
FIG. 1 depicts a prior art telescoping storage enclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Figure 2:
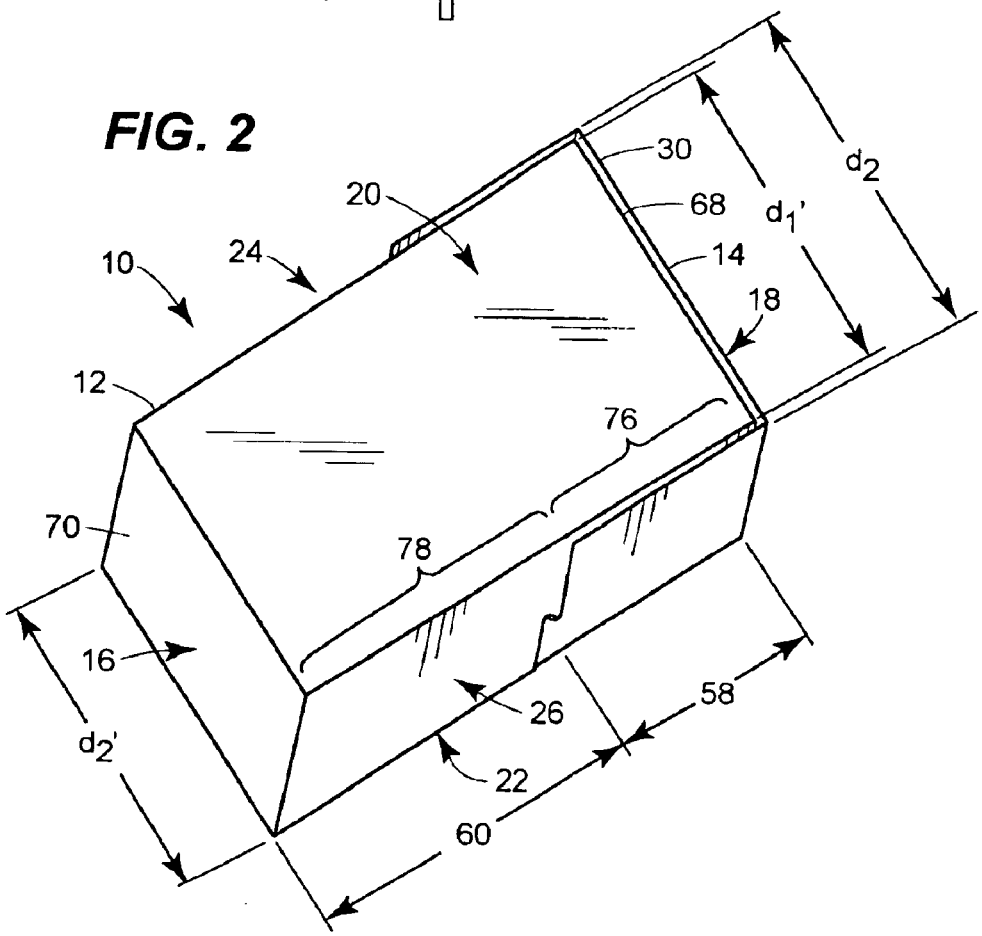
FIG. 2 depicts a self-telescoping storage enclosure constructed in accordance with the teachings of a first disclosed example of the present invention.

Referring now to the drawings, FIG. 2 depicts a first example of a self-telescoping storage enclosure 10, constructed in accordance with the teachings of this disclosure. The storage enclosure 10 includes a first or top tray 12 and a second or bottom tray 14 that are assembled to one other in a generally nested or interlocking relationship. The top tray 12 and the bottom tray 14 may have a similar or the same configuration such that the top and bottom tray 12 and 14 can be interchangeable. The trays 12, 14 may be made of corrugated paper, paperboard, plastic, metal, wood, any other formable material, or any combination thereof. The storage enclosure 10 may be used for the purpose of packaging, display and storage, or as a saleable product in itself.

The storage enclosure 10 is defined by a front side 16, a back side 18, a top side 20, a bottom side 22, a left side 24, and a right side 26. The labeling of these sides as such is only used herein to aid in the description of the storage enclosure 10, and no limitation should be read therein.

Figure 3:
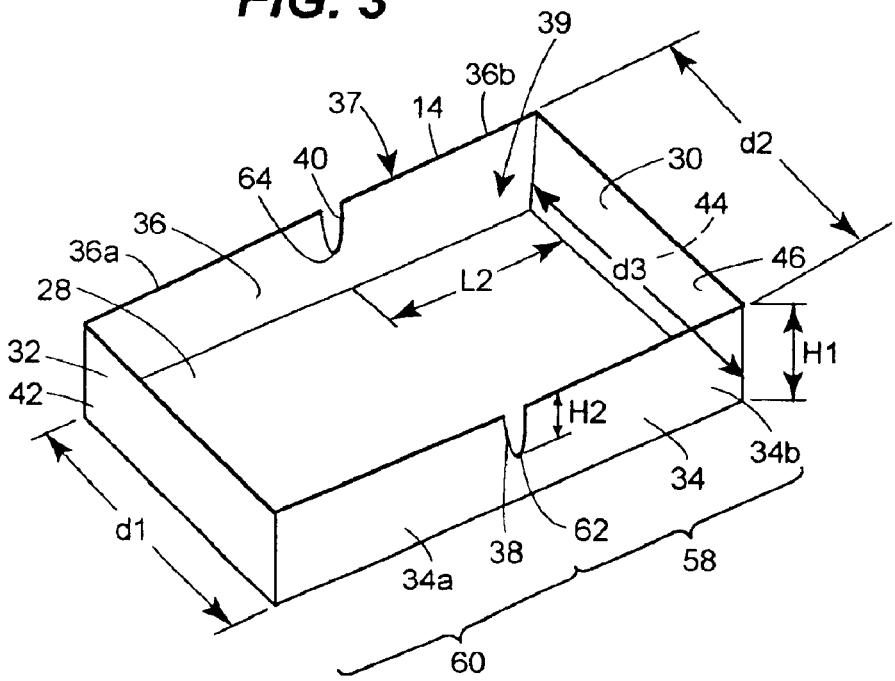
FIG. 3 depicts a perspective view of the bottom tray of the storage enclosure of FIG. 2.
Figure 4:
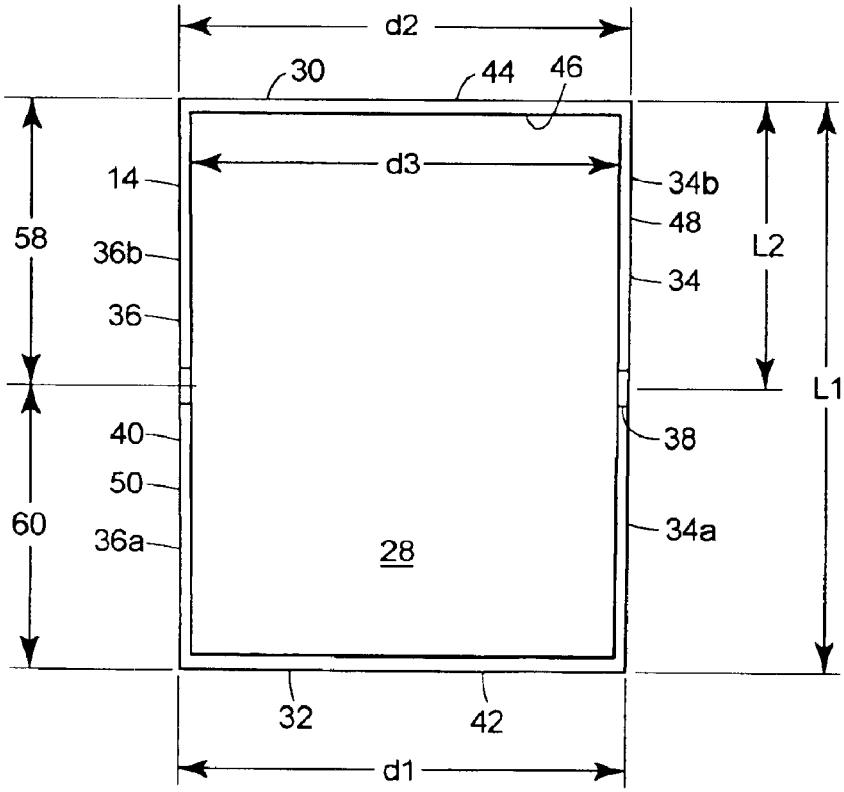
FIG. 4 depicts a plan view of the bottom tray.

As shown in FIGS. 3 and 4, the bottom tray 14 has a base or bottom wall 28. Extending up from the bottom wall 28 is a major wall 30, a minor wall 32, a right side wall 34 and a left side wall 36. The major wall 30, minor wall 32, right sidewall 34, and left sidewall 36 combine to form a single contiguous sidewall 37 and define an opening 39. A right notch 38 is disposed in the right side wall 34 and defines a right sidewall front portion 34*a* and a rear portion 34*b*. Likewise, a left notch 40 is disposed in the left sidewall 36 and defines a left side wall front portion 36*a* and a rear portion 36*b*. All of the walls 28, 30, 32, 34, 36 of the bottom tray 14 can have a wall thickness T.

The minor wall 32 has an outer surface 42 that defines an outer minor width d1. The major wall 32 has an outer surface 44 that defines an outer major width d2, and an inner surface 46 that defines an inner major width d3. As can be seen, the outer major width d2 is generally equal to the inner major width d3 plus twice the wall thickness T. The right side wall 34 has an outer surface 48 that defines an outside length L1. Similarly, the left side wall 36 has an outer surface 50 that also has the same outside length L1.

In the present example, the outer minor width d1 of the minor wall 32 is approximately equal to or slightly less than the inner major width d3 of the major wall 30. Because the outer major width d2 is greater than the outer minor width d1, i.e. the major wall 30 is slightly longer than the minor wall 32, the bottom wall 28 can be in the shape of a trapezoid, as seen in FIG. 4, with the major wall 30 defining the major edge of the trapezoid, and the minor wall 32 defining the minor edge.

Thus, a wide half 58 of the bottom tray 14 is defined by the major wall 30 and the left and right sidewall rear portions 34*b*, 36*b*. Likewise, a narrow half 60 of the bottom tray 14 is defined by the minor wall 32 and the left and right sidewall front portions 34*a*, 36*a*.

Referring particularly to FIG. 3, each of the major, minor, left and right side walls 30, 32, 34, 36 have a height H1. In the disclosed example, the height H1 is the same for each of the walls 30, 32, 34, 36. The right and left notches 38, 40 have a depth H2 which, in the disclosed example, is approximately one half the distance of H1. The right and left notches 58, 60 in the disclosed example may be approximately 0.25" wide, with a curved or semi-circular base 62, 64, and can be located on the right and left walls 34, 36 at a distance L2 from the back wall 30. The distance L2 is approximately one half the length of the distance L1.

Figure 5:
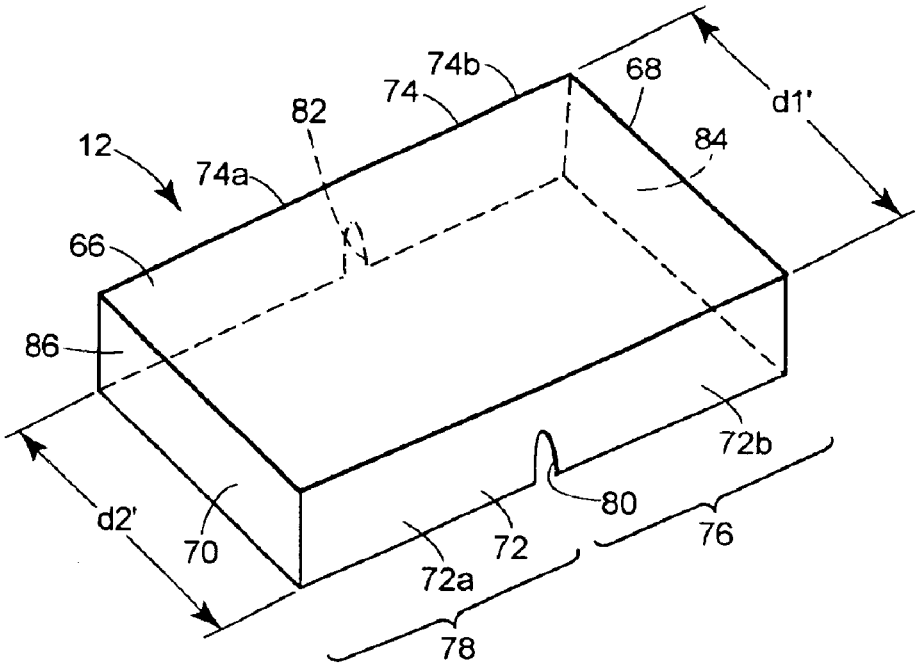
FIG. 5 depicts a perspective view of the top tray.

Referring to FIG. 5, the top tray 12 as shown is identical to the bottom tray 14. However, as shown, the top tray 12 has been oriented 180° about a reference axis extending generally through a right notch 80 and a left notch 82. Slight dimensional changes to either the bottom tray 14 or the top tray 12 can be implemented without affecting the ability of the top tray 12 and the bottom tray 14 to telescope on to one another.

The top tray 12 has a base or top wall 66. Extending down from the top wall 66 is a contiguous sidewall 67 that includes a minor wall 68, a major wall 70, a right side wall 72 and a left side wall 74 and defines an opening 75. The right side wall 72 includes the right notch 80 and a front portion 72*a* and a rear portion 72*b* divided by the right notch 80. Likewise, the left side wall 74 includes the left notch 82 and a front portion 74*a* and a rear portion 74*b* divided by the left notch 82.

Similarly to the bottom tray 14, in the top tray 12, the minor wall 68 includes an outer surface 84 that defines an outer minor width d1'. The major wall includes an outer surface 86 that defines an outer major width d2' greater than the outer minor width d1'.

A narrow half 76 of the top tray 12 is defined by the minor wall 68 and the left and right sidewall rear portions 72*b*, 74*b*. Likewise, a wide half 78 of the top tray 12 is defined by the major wall 70 and the left and right sidewall front portions 72*a*, 74*a*.

Figure 6:
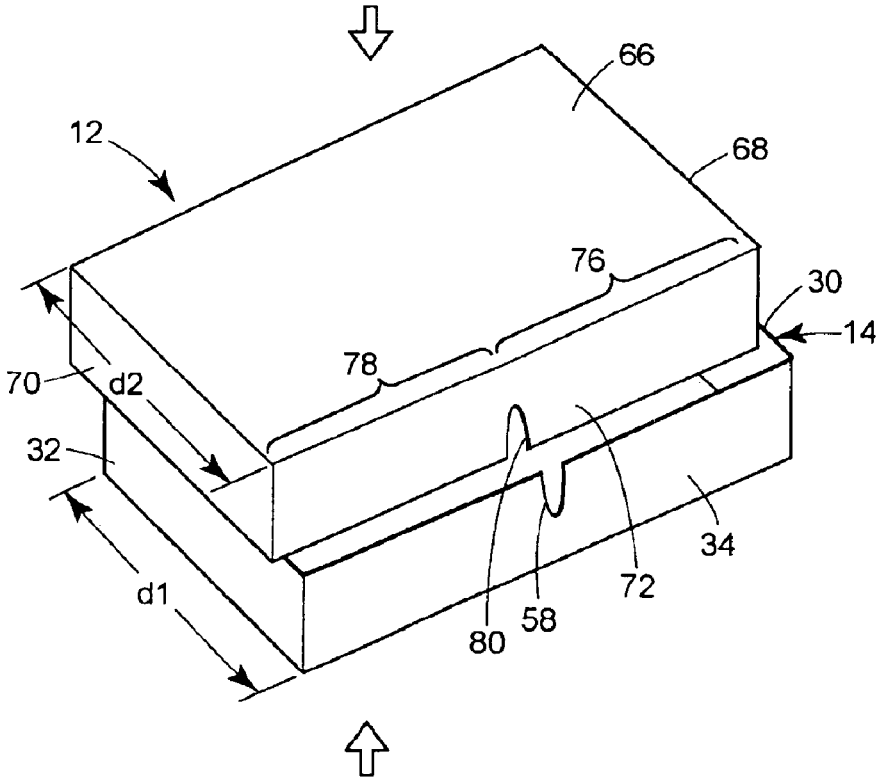
FIG. 6 depicts an exploded view of the top tray and the bottom tray prior to assembling the self-telescoping storage enclosure.

Referring now to FIG. 6, to assemble the self-telescoping tray 10, the top tray 12 is aligned vertically with the bottom tray 14. The right notch 80 in the top tray 12 is above the right notch 38 in the bottom tray 14, and the left notch 82 of the top tray 12 is above the left notch 40 in the bottom tray 14. The top tray 12 is then telescoped onto the bottom tray 14 to form the completed self-telescoping tray 10, as best seen in FIG. 2, with the notches 38, 40 of the bottom tray 14 interlocking with the notches 80, 82 of the top tray 12, respectively.

Referring back to FIG. 2, the storage enclosure 10 is depicted in its assembled state, with the top tray 12 being assembled to the bottom tray 14. The minor wall 68 of the top tray 12 and the major wall 30 of the bottom tray 14 are both disposed on the back side 14 of the storage enclosure 10. The minor wall 68 of the top tray 12 has an outer minor width d1', while the major wall 30 of the bottom tray 14 has an outer major width d2. Therefore, the narrow half 76 of the top tray 12 is disposed inside the wide half 58 of the bottom tray 14.

Likewise, the major wall 70 of the top tray 12 and the minor wall 32 of the bottom tray 14 are both disposed on the front side 16 of the storage enclosure 10. The major wall 70 of the top tray 12 has an outer major width d2' and the minor wall 32 of the bottom tray 14 has an outer minor width d1. The wide half 78 of the top tray 12 is disposed about and around the narrow half 60 of the bottom tray 14.

A transition occurs at the intersection of the notches 38, 40 of the bottom tray 14, and the notches 80, 82 of the top tray 12. In the portion of the storage enclosure 10 in front of the notches 38, 40, 80, 82, the right and left side walls 72*a*, 74*a* of the top tray 12 are outside the right and left side walls 34*a*, 36*a* of the bottom tray 14, and in the portion of the storage enclosure in back of the notches 38, 40, 80, 82, the right and left side walls 72*b*, 74*b* of the top tray 12 are inside the right and left side walls 34*b*, 36*b* of the bottom tray 14. This is accomplished by the slight trapezoidal shape of the trays 12, 14, as shown in FIG. 3, and the inter-engaging notches 38, 40 80, 82 in the side walls 34, 36, 72, 74.

The self-telescoping tray system assembled according to the disclosed example may offer one or more advantages, including that both the top tray 12 and the bottom tray 14 can be made identical to one another. Thus, the top tray 12 and bottom tray 14 can be manufactured by one machine, one mold cavity, or one process, thereby lowering initial outlay costs. Further, assembly is simple because it is not required to store, stock, locate, and acquire one of each of a different top and bottom tray for assembly, thereby lowering assembly costs. Replacement of a damaged tray is also easier, because the user does not have to specify which of the trays is needed. For the purchaser, there will be an added economy of scale, because twice the amount of one size is purchased. It is also easier for the manufacturer to control the inventory, since only one part need be stored and tracked.

Figure 7:
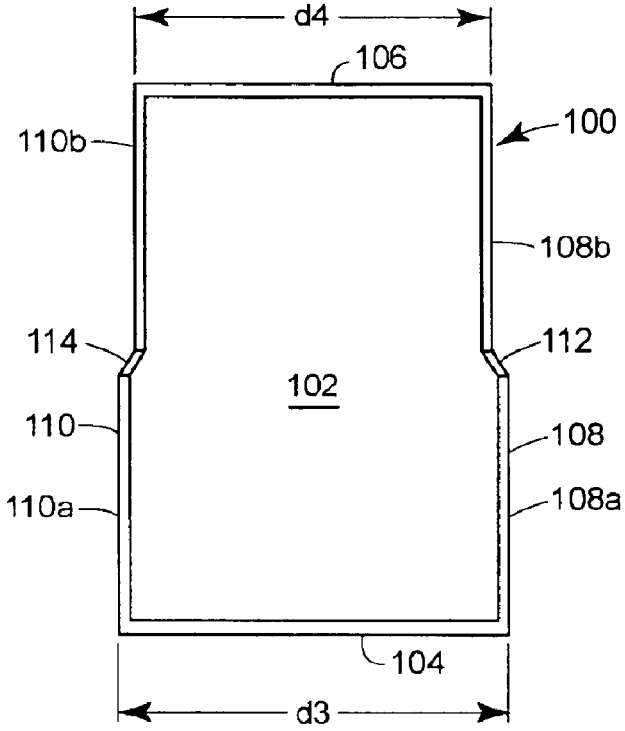
FIG. 7 is a plan view of a second example of one of the top tray or bottom tray.

FIG. 7 depicts a second example of a tray 100 that can be one of two identical trays adapted to form a self-telescoping storage enclosure. The tray 100 includes a bottom wall 102. Extending up from the bottom wall 102 are a major wall 104, a minor wall 106, a right side wall 108, and a left side wall 110. The right side wall 108 includes a right notch 112 that divides the right side wall 108 into a front portion 108*a* and a rear portion 108*b*. Likewise, the left side wall 110 includes a left notch 114 that divides the left side wall 110 into a front portion 110*a* and a rear portion 110*b*. Again, the major wall has an outer major width d3, and the minor wall has an outer minor width d4 less than the major wall outside length d3.

In this example, however, the bottom wall 102 is not trapezoidal in shape. Instead, the left and right sidewalls 108, 110 extend substantially perpendicular away from the major and minor walls 104, 106. To ensure that a second tray substantially identical to the tray 100 can telescope over the tray 100 as described previously in the first example, the left and right sidewalls 108, 110 angle slightly inward in the area of the notches 112 and 114.

Figure 8:
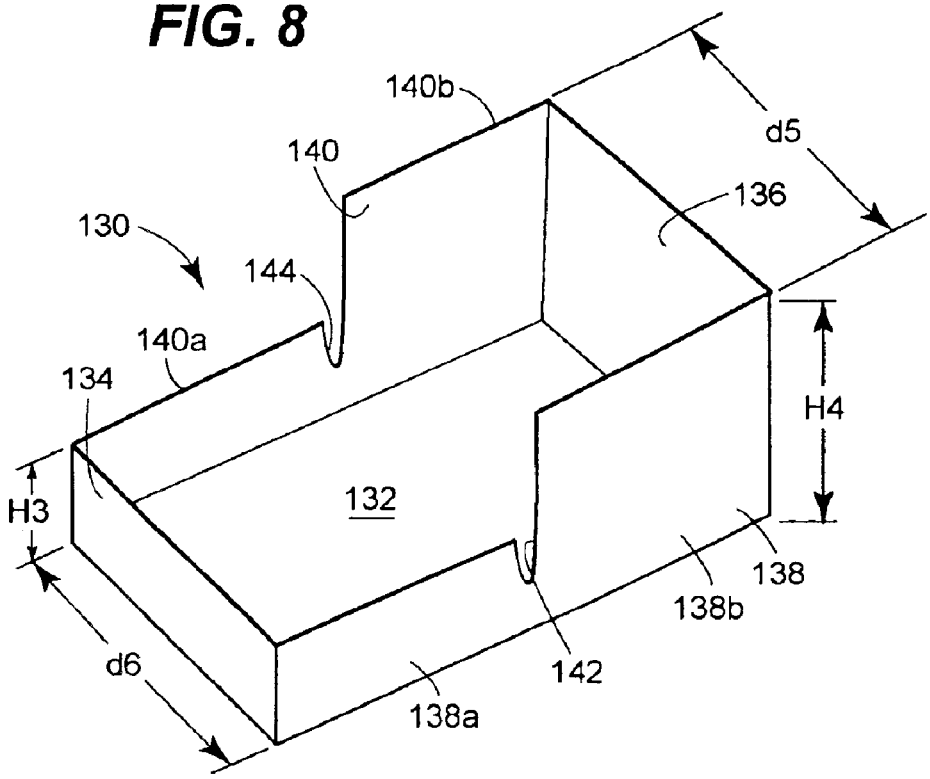
FIG. 8 depicts a third example of a bottom tray for a telescoping tray storage enclosure.

FIG. 8 depicts a third example of a tray 130 that can be one of two identical trays adapted to form a self-telescoping storage enclosure. The bottom tray 130 includes a bottom wall 132. Extending up from the bottom wall 132 are a minor wall 134, a major wall 136, a right side wall 138, and a left side wall 140. The right side wall 138 includes a right notch 142 that divides the right sidewall into a front portion 138*a* and a rear portion 138*b*. Likewise, the left sidewall 140 includes a left notch 144 that divides the left sidewall 140 into a front portion 140*a* and a rear portion 140*b*. The major wall has an outer major width d5, and the minor wall has an outer minor width d6 less than the outer major width d5.

In this example, the minor wall 134 and the front portions of the right and left walls 138*a* and 140*a* have a height H3. The major wall 136 and the rear portions of the right and left walls 138*b* and 140*b* have a height H4 greater than height H3. The transition between the height H3 and the height H4 in the right and left walls 138, 140 occurs at right and left notches 146, 148, which is approximately midway between the front wall 134 and the back wall 136.

In all other aspects, the tray 130 of the third example is similar to those described in the first example, including the minor wall 134 having an outside narrow width d6 which is less than the outside wide width d5 of the major wall 136. A second tray (not shown), with dimensions similar to the tray 130, is disposed on the tray 130 in a manner described as in the previous example to form a self-telescoping storage enclosure.

In this embodiment, the major wall 136 is much taller than the minor wall 134. This can be useful in point of display sales in which a customer reaches into the bottom tray 130 to acquire the items held therein for purchase. By doing so, the customer most likely pushes the contents of the tray 130 towards the major wall 136. Since the major wall 136 has a taller height than the minor wall 134, the contents of the tray 130 are not pushed over the edge and out of the tray 130. By increasing the height H4 of the back wall 136, spillage can be lessened.

In a further example not shown, it would be possible for the major and minor walls to have the same width dimension. In this example, the first tray and the second tray could telescope over one another due to the flexibility of the right and left sidewalls.

The foregoing description is not intended to limit the scope of the invention to the precise form disclosed. It is contemplated that various changes and modifications may be made by those skilled in the art without departing from the spirit and scope of the invention.

I claim:

1. A self-telescoping storage enclosure, comprising:

a first tray, including a base wall, and a single contiguous sidewall extending up from the base wall, the single contiguous sidewall including a major wall and a minor wall opposite the major wall, and a right wall and a left wall opposite the right wall, wherein the major wall and the minor wall each have an outer surface;

a left notch disposed in the left wall and a right notch disposed in the right wall, the left notch being disposed half way between the major wall and the minor wall, the right notch being disposed half way between the major wall and the minor wall;

the outer surface of the major wall defining a first major outer width, and the outer surface of the minor wall defining a first minor outer width, the first major outer width being greater than the first minor outer width; and wherein the first tray can nest with a second tray that is substantially similar to the first tray and that is inverted and oriented 180° relative to the first tray by the inter-engagement of their respective notches.

2. The storage enclosure of claim 1, wherein the left wall and the right wall each further have a thickness, wherein the outer major width is greater than or equal to the outer minor width plus the thickness of the left wall plus the thickness of the right wall.

3. The storage enclosure of claim 1, wherein the bottom wall is a trapezoid.

4. The storage enclosure of claim 1, wherein the right wall defines a first height, and wherein the depth of the right notch is approximately one half of the first height.

5. The storage enclosure of claim 1, wherein the major wall defines a first height and the minor wall defines a second height, wherein the first height does not equal the second height.

6. The storage enclosure of claim 5, wherein the first height is greater than the second height.

7. The storage enclosure of claim 1, wherein the left wall and the right wall extend substantially perpendicularly from the major wall and the minor wall.

8. The storage enclosure of claim 1, wherein the notches of the first tray interengage the notches of the second tray.

9. A self-telescoping storage enclosure, comprising:

a first tray, including a base wall, and a single contiguous sidewall extending up from the base wall, the single contiguous sidewall including a major wall and a minor wall opposite the major wall, and a right wall and a left wall opposite the right wall, wherein the major wall and the minor wall each have an outer surface;

a left notch disposed in the left wall and a right notch disposed in the right wall;

the outer surface of the major wall defining a first major outer width, and the outer surface of the minor wall defining a first minor outer width, the first major outer width being greater than the first minor outer width;

wherein the first tray can nest with a second tray that is substantially similar to the first tray and that is inverted and oriented 180° relative to the first tray by the inter-engagement of their respective notches;

wherein the left wall extends substantially perpendicularly away from the major wall, and the right wall extends substantially perpendicularly away from the major wall; and wherein in the area of the left notch, the left wall is generally non-perpendicular to the major wall.

10. The storage enclosure claim 9, wherein in the area of the right notch, the right wall is generally non-perpendicular to the major wall.

11. The storage enclosure of claim 9, wherein the major wall defines a first height, and the minor wall defines a second height, wherein the first height does not equal the second height.

12. The storage enclosure of claim 11, wherein the first height is greater than the second height.

13. The storage enclosure of claim 9, wherein the left wall and the right wall each further have a thickness, wherein the outer major width is greater than or equal to the outer minor width plus the thickness of the left wall plus the thickness of the right wall.

14. The storage enclosure of claim 9, wherein the left wall defines a first height, and wherein the depth of the left notch is approximately one half of the first height.

15. The storage enclosure of claim 9, wherein the notches of the first tray interengage the notches of the second tray.

16. A self-telescoping storage enclosure, comprising:

a first tray including a first base wall and a first contiguous sidewall extending up from the first base wall, the first contiguous sidewall including a first major wall, a first minor wall opposite the first major wall, a first right wall and a first left wall opposite the first right wall, the first left wall and the first right wall each including a notch;

the first major wall having a first outer surface that defines a first major outer width and the first minor wall having a first outer surface that defines a first minor outer width, the first major outer width being longer than the first minor outer width;

a second tray including a second base wall and a second contiguous sidewall extending up from the second base wall, the second contiguous sidewall including a second major wall, a second minor wall opposite the second major wall, a second right wall and a second left wall opposite the second right wall, the second left wall and the second right wall each including a notch;

the second major wall having a second outer surface that defines a second major outer width and the second minor wall having a second outer surface that defines a second minor outer width, the second major outer width being longer than the second minor outer width;

wherein the second tray is disposed on the first tray such that the second minor wall is inside the first major wall, and the first minor wall is inside the second major wall; and wherein the notch on the left wall is disposed approximately midway along the length of the left wall and the notch of the right wall is disposed approximately midway along the length of the right wall.

17. The storage enclosure of claim 16, wherein the first major wall defines a first height, and the first minor wall defines a second height, wherein the first height is greater than the second height.

18. The storage enclosure of claim 17, wherein the second major wall has a height equal to the first height, and the second minor wall has a height equal to the second height.

19. The storage enclosure claim 16, wherein the notches of the first tray interengage the notches of the second tray.

* * * * *